US006821141B1

(12) United States Patent
Liu

(10) Patent No.: US 6,821,141 B1
(45) Date of Patent: Nov. 23, 2004

(54) SLIDING TRACK ASSEMBLY FOR MOBILE PC BOARD

(75) Inventor: Su-Lin Liu, Taipei (TW)

(73) Assignee: Tatung Co., Ltd., Taipei (TW)

( * ) Notice: Subject to any disclaimer, the term of this patent is extended or adjusted under 35 U.S.C. 154(b) by 0 days.

(21) Appl. No.: 10/811,886

(22) Filed: Mar. 30, 2004

(30) Foreign Application Priority Data

Jun. 25, 2003 (TW) ..... 92211621 U

(51) Int. Cl.[7] ..... H01R 13/64

(52) U.S. Cl. ..... 439/377; 439/64; 361/802

(58) Field of Search ..... 439/64, 377, 374; 361/802

(56) References Cited

U.S. PATENT DOCUMENTS

| | | | | | |
|---|---|---|---|---|---|
| 4,098,046 | A | * | 7/1978 | Papa | 52/716.1 |
| 4,214,292 | A | * | 7/1980 | Johnson | 361/721 |
| 5,055,061 | A | * | 10/1991 | Lichtenwalter | 439/377 |
| 6,115,242 | A | * | 9/2000 | Lambrecht | 361/684 |
| 6,373,712 | B1 | * | 4/2002 | Bailis et al. | 361/756 |
| 6,735,093 | B2 | * | 5/2004 | Mu-Tsai | 361/818 |

* cited by examiner

*Primary Examiner*—Tho D. Ta
(74) *Attorney, Agent, or Firm*—Bacon & Thomas PLLC

(57) ABSTRACT

A sliding track assembly includes two side boards formed inside the case of a computer, and a plurality of circular locating members symmetrically mounted on the inner surface of each side board to define a narrow gap on each side board for use as a sliding way for receiving a mobile PC board without producing much friction upon insertion of the mobile PC board.

9 Claims, 3 Drawing Sheets

SLIDING TRACK ASSEMBLY FOR MOBILE PC BOARD

BACKGROUND OF THE INVENTION

1. Field of the Invention

The present invention relates to a sliding track assembly and, more specifically, to a sliding track assembly for mobile PC board.

2. Description of Related Art

A blade server is a powerfully computable device which is popularly invited in the market. In regular blade servers, mobile PC boards are used for the advantage of being easy to upgrade. For example, a PC board having specific functions is modularized and packed to form a mobile PC board. A sliding track assembly is provided inside a blade server and has two sliding tracks bilaterally provided on the inside for sliding the mobile PC board and supporting the mobile PC board in position. If a user desires to upgrade one function of component parts of the mobile PC board, the upgrade procedure is taking the old model mobile PC board away from the sliding track assembly, and then inserting a new model of mobile PC board into the sliding track assembly for a replacement. This component parts upgrading procedure is quite simple.

FIG. 1 illustrates a sliding track assembly 10 provided inside a blade server 5 according to the prior art. The sliding track assembly 10 comprises two sliding tracks 12 respectively provided on the inner side of each of the two opposite side boards thereof. The sliding tracks 12 are respectively made by stamping respective iron plate members 121 into substantially I-shaped or U-shaped bars, or formed of plastic card guides. The mobile PC board 14 can be inserted into the sliding tracks 12 (set in the sliding track assembly 10). However, either made of iron plate members or plastic card guides, the sliding tracks 12 provide a surface contact when received the mobile PC board 14. Therefore, the user needs to employ much effort to the mobile PC board 14 to overcome the friction force between the sliding tracks 12 and the mobile PC board 14 when inserting the mobile PC board 14 into the sliding tracks 12. Further, the rough edges of the sliding tracks 12, if made of iron plate members 121, may scratch the surface of the mobile PC board 14, causing the mobile PC board to make a short circuit.

Therefore, it is desirable to provide a sliding track assembly for mobile PC board that eliminates the aforesaid drawbacks.

SUMMARY OF THE INVENTION

The present invention has been accomplished under the circumstances in view. It is therefore the main object of the present invention to provide a sliding track assembly for mobile PC board, which reduces friction for enabling the mobile PC board to be easily inserted into the sliding track assembly.

It is another object of the present invention to provide a sliding track assembly for mobile PC board, which does not scratch the surface of the mobile PC board.

It is still another object of the present invention to provide a sliding track assembly for mobile PC board, which is inexpensive to manufacture.

According to one aspect of the present invention, A sliding track assembly is disclosed and comprises two side boards, and two parallel sliding tracks respectively form in corresponding inner sides of the side boards and adapt to receive a mobile PC board, wherein the parallel sliding tracks each comprises: a sliding way, the sliding way haves a width greater than the thickness of the mobile PC board; at least two lower circular locating members align in a line, the at least two lower circular locating members each has a top side adjacent to a bottom side of the sliding way; and at least one upper circular locating member, the at least one upper circular locating member has a bottom side adjacent to a top side of the sliding way.

Because the circular locating members have a smooth surface and provide a small contact area and narrow sliding ways and because the circular locating members are inexpensive to manufacture and easy to install, the invention achieves the aforesaid objects.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
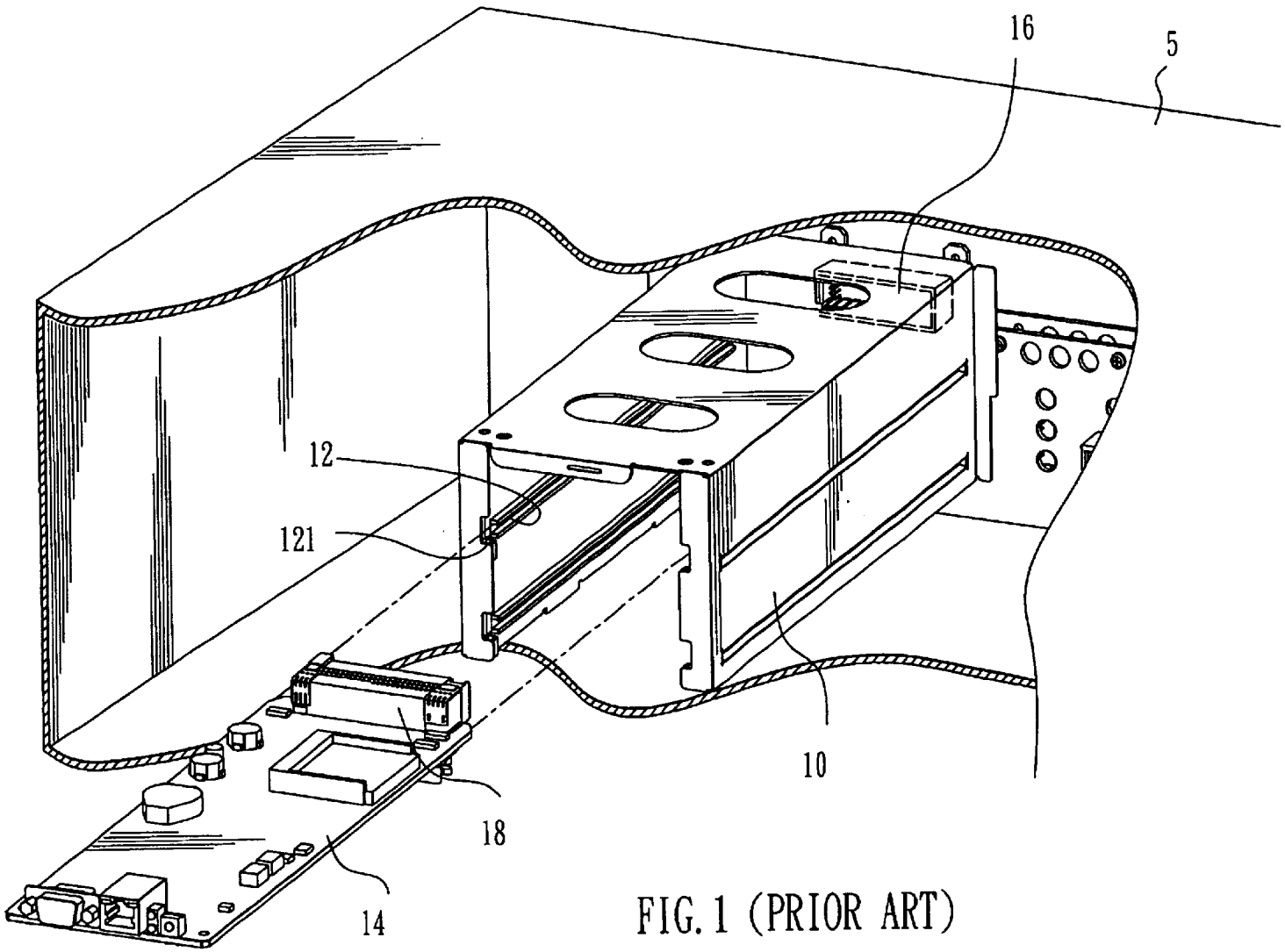
FIG. 1 (PRIOR ART)
FIG. 1 is a schematic drawing showing the relationship between a sliding track assembly and a mobile PC board according to the prior art.
Figure 2:
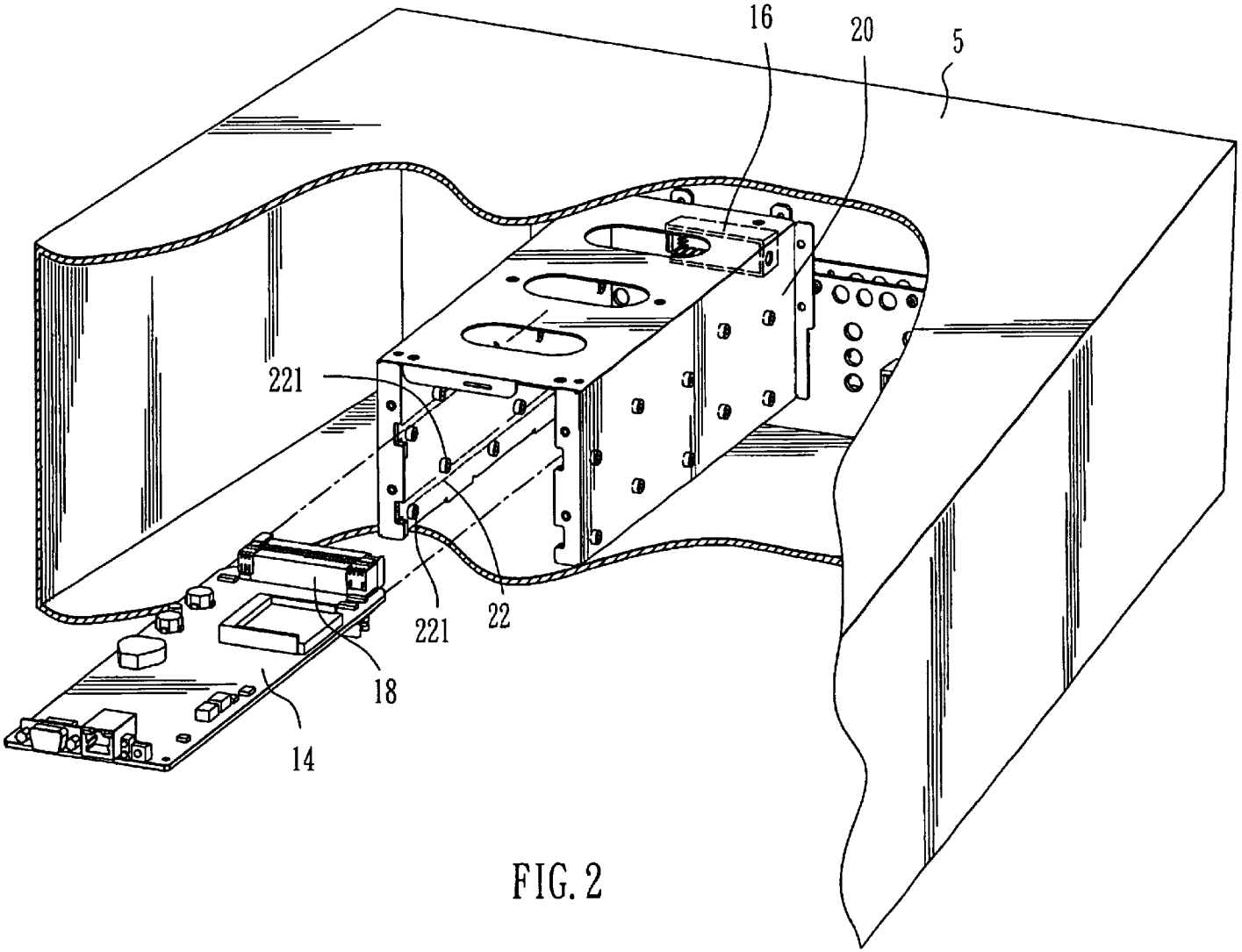
FIG. 2 is a schematic drawing of a sliding track assembly for mobile PC board according to the present invention.

Referring to FIG. 2, a sliding track assembly 20 is mounted on two side boards inside a blade server 5, having at least one pair, for example, two pairs of parallel sliding ways 22 arranged on the inside at different elevations and respectively adapted to guide a mobile PC board 14 into the inside of the sliding track assembly 20 and to support the inserted mobile PC board 14 in position. Each sliding way 22 is defined by five circular locating members 221. The five circular locating members 221 are alternatively arranged at two different elevations, i.e. the five circular locating members include three lower circular locating members aligned in a line along the bottom side of the corresponding sliding way and two upper circular locating members aligned in a line along the top side of the corresponding sliding way 22 above the elevation of the lower circular locating members. When inserting one mobile PC board 14 into one parallel pair of sliding ways 22, the three lower circular locating members 221 of each sliding way 22 provide a supporting force to the mobile PC board 14, and the two upper circular locating members 221 of each sliding way 22 give a downward pressure to the mobile PC board 4, keeping the mobile PC board 4 to be moved along the corresponding sliding ways 22 correctly. After the mobile PC board 14 has been fully inserted into the inside of the sliding track assembly 20, the electric connector 18 of the mobile PC board 14 is electrically connected to the matching electric connector 16 mounted on a blade server 5 and at the rear ends of the parallel sliding tracks, for enabling electronic signal of the mobile PC board 14 to be communicated with the blade server 5. The connection between the electric connectors 16 and 18 produces a friction force that retains the mobile PC board 14 to the sliding track assembly 20 firmly.

The contact between the circular locating members 221 of the sliding ways 22 and the mobile PC board 14 is an axial line contact. To achieve this axial line contact, the circular locating members 221 can be variously embodied. For example, the circular locating members 221 can be metal stub round rods, plastic stub round rods, or metal spherical members. If metal stub round rods are used for the circular locating members 221, the metal stub round rods, in addition to the function of forming the desired sliding ways 22, increase the grounding contact points (or grounding contact area) of the mobile PC board 14, enhancing the electronic signal characteristics of the mobile PC board 14. If plastic stub round rods are used for the circular locating members 221, the plastic stub round rods, in addition to the function of forming the desired sliding ways 22, provide an electrically insulative environment to the mobile PC board 14, eliminating signal interference between the mobile PC board 14 and electronic members of the blade server 5.

The circular locating members 221 may be fastened to the inside wall of the sliding track assembly 20 by means of any of a variety of mounting methods including soldering, hooking, riveting, embedding, bonding, or threading. For example, the circular locating members 221 can be directly soldered or bonded to the inside wall of the sliding track assembly 20, forming the desired sliding ways 22. Alternatively, punch holes can be formed in the inside wall of the sliding track assembly 20 for the mounting of the circular locating members 221 by means of riveting, embedding, hooking, or threading, to form the desired sliding ways 22.

Figure 3:
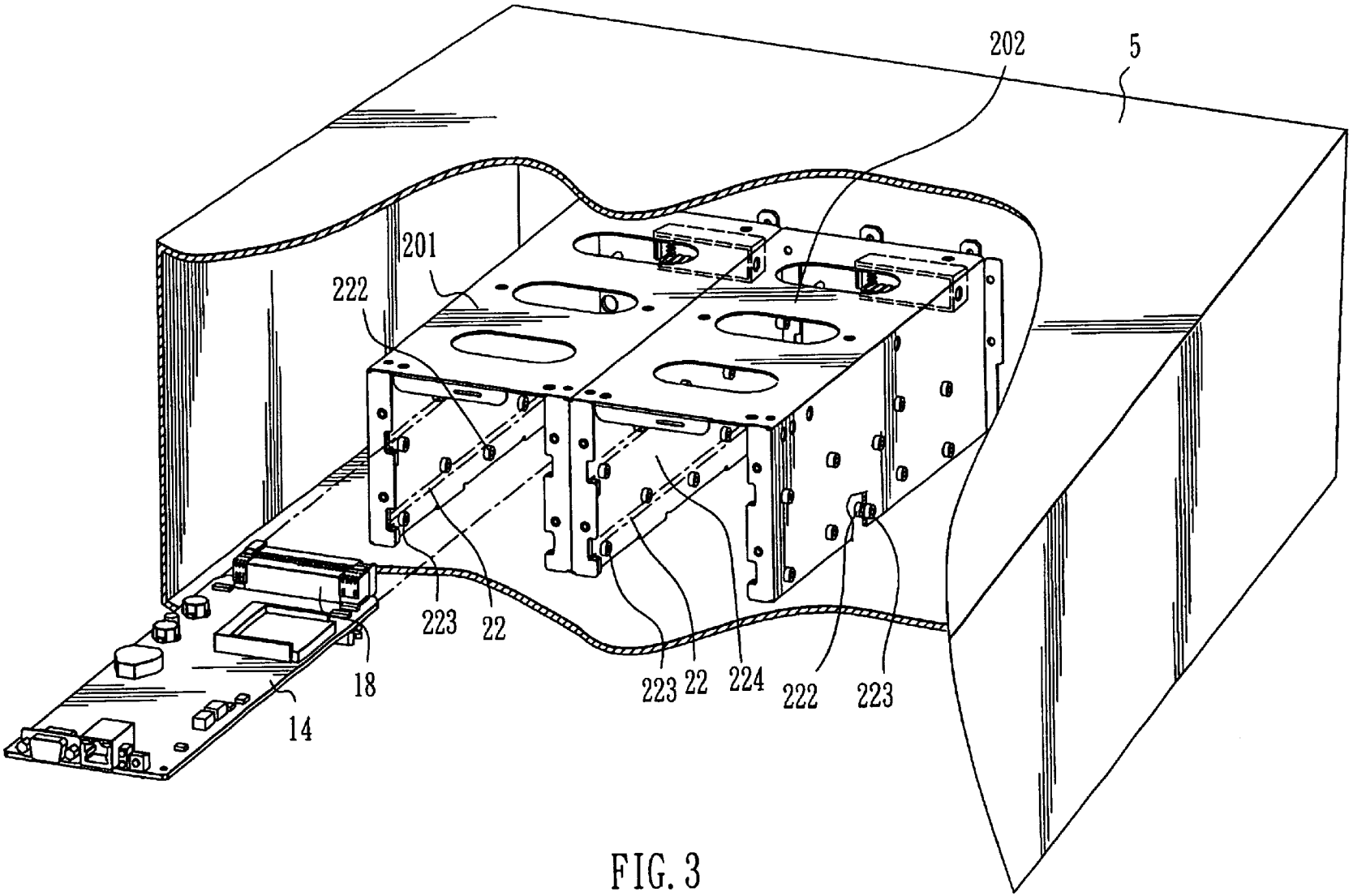
FIG. 3 is a schematic drawing showing an alternate form of the present invention.

FIG. 3 illustrates an alternate form of the present invention. According to this embodiment, two sliding track assemblies 201 and 202 are abutted against each other inside the blade server 5. The sliding track assemblies 201 and 202 each have at least one pair, for example, two pairs of parallel sliding ways 22 arranged on the inside at different elevations and respectively adapted to accommodate a mobile PC board 14. Each sliding way 22 is defined by five circular locating members each formed of a circular male locating element 222 and a circular female locating element 223. According to this embodiment, the circular male locating element 222 is a screw rod, and the circular female locating element 223 a female screw adapted to receive the screw rod. Further, the two sliding track assemblies 201 and 202 have a common sidewall 224, which has punch holes for the mounting of common circular locating members. This design reduces the manufacturing cost of the sliding track assemblies 201 and 202.

Because the fabrication of the circular locating members 221 and the circular locating elements 222, 223 is simpler than the prior art method of processing iron plate members into sliding tracks, the cost of forming the desired sliding ways 22 in the sliding track assembly 20 is greatly reduced. The circular locating members 221, the circular locating elements 222 and 223 can be made by press molding for the advantage of having a smooth surface. Sliding ways 22 formed of the circular locating members 221 and the circular locating elements 222, 223 neither scratch the surface of the mobile PC board 14 nor cause the mobile PC board 14 to make a short circuit The width of the sliding ways 22 is determined subject to the positioning of the circular locating members 221 and the circular locating elements 222, 223. Therefore, the width of the sliding ways 22 can be minimized to reduce friction force between the mobile PC board 14 and the sliding ways 22. Further, the sliding ways 22 receive only a small part of the border area of the mobile PC board 14, the mobile PC board 14 has a broad board space for the arrangement of component parts.

The contact between the circular locating members 221 or the circular locating elements 222, 223 is a line contact. However, polygonal or triangular locating members may be used to substitute for the circular locating members 221 or the circular locating elements 222, 223 for line contact with the mobile PC board 14. Polygonal or triangular locating members can also achieve the same advantages of the circular locating members 221 and the circular locating elements 222, 223.

Further, the sliding track assemblies of the present invention can also be used to receive other modularized electronic devices, such as mobile fan modules, mobile hard disk drive modules, or mobile power supply modules. Except blade server, the invention can also be employed to a desk-top computer or notebook computer.

Because the circular locating members 221 and the circular locating elements 222, 223 have a smooth surface exposed to the outside and provide a small contact area and narrow sliding ways 22 to the mobile PC board and because the manufacturing cost of the sliding ways 22 is relatively cheaper than the prior art design, the objects of the present invention can be achieved.

A prototype of sliding track assembly for mobile PC board has been constructed with the features of FIGS. 2 and 3. The sliding track assembly functions smoothly to provide all of the features discussed earlier.

Although particular embodiments of the present invention have been described in detail for purposes of illustration, various modifications and enhancements may be made without departing from the spirit and scope of the invention. Accordingly, the invention is not to be limited except as by the appended claims.

What is claimed is:

1. A sliding track assembly comprising two side boards, and two parallel sliding tracks respectively formed in corresponding inner sides of the side boards and adapted to receive a mobile PC board, wherein the parallel sliding tracks each comprises:

a sliding way, the sliding way having a width greater than the thickness of the mobile PC board;

at least two lower circular locating members aligned in a line, the at least two lower circular locating members each having a top side adjacent to a bottom side of the sliding way; and at least one upper circular locating member, the at least one upper circular locating member having a bottom side adjacent to a top side of the sliding way.

2. The sliding track assembly as claimed in claim 1, the sliding track assembly further comprising a first electric connector mounted between two respective rear ends of the parallel sliding tracks, the mobile PC board further comprising a second electric connector in a rear end thereof, when the mobile PC board is inserted into the sliding tracks assembly completely along the parallel sliding tracks, the first electric connector is coupled and electrically connected to the corresponding second electric connector of the mobile PC board.

3. The sliding track assembly as claimed in claim 1, wherein the at least two lower circular locating members are metal stub round rods.

4. The sliding track assembly as claimed in claim 1, wherein the at least one upper circular locating member is a metal stub round rod.

5. The sliding track assembly as claimed in claim 1, wherein the at least two lower circular locating members are plastic stub round rods.

6. The sliding track assembly as claimed in claim 1, wherein the at least one upper circular locating member is a plastic stub round rod.

7. The sliding track assembly as claimed in claim 1, wherein the side boards each have a plurality of punch holes, and the at least two lower circular locating members and at least one upper circular locating member of each of the parallel sliding tracks are riveted to the punch holes respectively.

8. The sliding track assembly as claimed in claim 1, wherein the side boards are mounted inside the case of a blade server.

9. The sliding track assembly as claimed in claim 1, wherein the side boards are mounted inside the mainframe of a personal computer.

* * * * *